United States Patent [19]

Hoffmann et al.

[11] 4,414,488

[45] Nov. 8, 1983

[54] APPARATUS FOR PRODUCING A DISCHARGE IN A SUPERSONIC GAS FLOW

[75] Inventors: Peter Hoffmann, Stuttgart; Helmut Hügel, Sindelfingen; Wolfgang Schall, Leinfelden-Echterdingen; Schock, Wolfram, Sindelfingen, all of Fed. Rep. of Germany

[73] Assignee: Deutsche Forschungs- und Versuchsanstalt für Luft-und Raumfahrt e.V., Bonn, Fed. Rep. of Germany

[21] Appl. No.: 163,281

[22] Filed: Jun. 26, 1980

[30] Foreign Application Priority Data

Dec. 22, 1979 [DE] Fed. Rep. of Germany ..... 2952046

[51] Int. Cl.[3] ..... H01J 7/46; H01J 19/80

[52] U.S. Cl. ..... 315/39; 315/111.31; 315/111.51; 372/64; 372/72

[58] Field of Search ..... 315/39, 111.31, 111.51, 315/111.21; 331/94.5 G; 372/64, 72, 76, 83, 86

[56] References Cited

U.S. PATENT DOCUMENTS

| | | | |
|---|---|---|---|
| 2,762,872 | 9/1956 | Dicke | 315/39 X |
| 3,083,528 | 4/1963 | Brown | 315/39 X |
| 3,280,364 | 10/1966 | Sugawara et al. | 315/111.31 |
| 3,313,979 | 4/1967 | Landauer | 315/39 |
| 3,418,206 | 12/1968 | Hall et al. | 315/39 X |
| 3,541,372 | 11/1970 | Omura et al. | 315/39 X |
| 3,641,389 | 2/1972 | Leidigh | 315/39 |
| 3,872,349 | 3/1975 | Spero et al. | 315/39 |
| 3,911,318 | 10/1975 | Spero et al. | 315/39 |
| 4,004,249 | 1/1977 | Kikuchi | 372/64 |
| 4,200,819 | 4/1980 | Haslund | 331/94.5 G |

*Primary Examiner*—Saxfield Chatmon, Jr.

*Attorney, Agent, or Firm*—Bernard, Rothwell & Brown

[57] ABSTRACT

Disclosure is directed to an apparatus for producing a microwave discharge in a supersonic gas flow such that the available microwave energy is deposited in the gas as completely and uniformly as possible through a substantial cross-section of the flow channel. The flow channel is provided within a waveguide and microwave energy is caused to be propagated through the waveguide substantially in the direction of the gas flow. A supersonic nozzle is provided in the channel dividing the channel into an upstream plenum and a downstream low pressure region, and the electric discharge occurs in the low pressure region just beyond the nozzle throat.

7 Claims, 14 Drawing Figures

APPARATUS FOR PRODUCING A DISCHARGE IN A SUPERSONIC GAS FLOW

The invention relates to a method of producing a discharge in a supersonic gas flow by superposition of a microwave field and a gas flow.

The invention, furthermore, relates to an apparatus for performing this method, comprising a channel for the gas flow and a supersonic nozzle in the channel for expansion and simultaneous acceleration of the gas to supersonic speed, which divides the channel into an upstream plenum and a downstream low pressure region.

The excitation of gases is important in various applications. For example, it is known to sustain a discharge in gases or gas mixtures in order to initiate plasma-chemical processes therein. Excitation of a gas flow is also required to produce a laser-active gas flow, and this excitation is, as a rule, brought about by a discharge.

The use of high frequency fields in the gigacycles region (microwaves) to produce and sustain gas discharges in gases or gas mixtures at rest or in motion has been known for a long time (J. Appl. Physics, 22 (1951), 6, page 835 et seq.; Review Sci-Instr., 36 (1965), 3, March 1, page 294 et seq.). Inter alia, microwaves are characterized by the wavelength of the radiation being of the same size as a typical discharge geometry. Consequently, the field distribution for producing the discharge can be adapted to the given task by suitable geometric design of the discharge system.

In a known system, for example, there is created at the open end of a coaxial waveguide a high field strength, which causes a microwave discharge attached to the central guide to be produced in the free atmosphere, with a slow gas flow emerging from the coaxial waveguide being superposed (J. Appl. Physics, 22 (1951), 6, page 835 et seq.). However, this system eliminates the essential advantage of microwave discharges: a plasma without electrode material impurities.

Discharges below atmospheric pressure are produced by the different varieties of microwave cavities, referred to, for example, in Review Sci. Instr., 36 (1965), March, page 294 et seq., and Proc. IEEE, 62 (1974), 1, January, page 109 et seq. Here, use is made of the fact that particularly high field strengths occur in microwave cavities with suitable geometry and coupling. When a closed or open discharge tube made of dielectric material with low loss angle (preferably fused silica), with a gas flowing through it, is applied to the points of high field strength, a discharge is produced therein. Such discharges are used in the investigation and performance of plasma-chemical processes (Microwave Power Engineering, Volume 2, 1968, Academic Press, N.Y.) or, for example, in the dissociation of halogens in order to initiate the excitation processes required for chemical lasers (IEEE J. Quantum Electronics QE 9 (1973), 1, page 163 et seq.).

One is naturally interested in allowing as large quantities of gas as possible to be acted upon by the microwave discharge. However, the size of the microwave cavities with well defined modes is limited by the wavelength of the radiation. To date, two methods are known which partly solve the problem. According to the process of British Pat. No. 1,367,094 a slow wave structure acting as an appropriately shaped antenna (slow wave structure for large volume microwave plasma generator: LMP) is used for the coupling of radiation into a discharge, whereas in the process according to German Offenlegungsschrift (patent application laid open to public inspection) No. 2,548,220 ionizing surface waves are produced on a long plasma column (Surfatron) with the aid of a microwave-cavity-like apparatus. Common to both processes is, however, the problem that it is not possible to deposit all of the available microwave power in the plasma (vide IEEE Transactions on Plasma Science PS 2 (1974), page 273 et seq., and IEEE Journal Quantum Electronics, QE-14 (1978), 1, page 8 et seq.).

Repeated use has been made of microwave discharges in gas at rest or in slow motion as laser-active media, but without any significant advantage over conventional discharges (Proc. IEEE 52 (1964) 1737; AFIT/EN Report AD 776 349; J. Appl. Physics, 49 (1978), 7, page 3753 to 3756). In the systems with superposed gas flow, the coupling of relatively low power permitted only a low gas flow rate at subsonic speed. According to ISL Report R 111/77 and the semiannual ISL Report CR 74/29, microwave energy was successfully coupled into a discharge channel having a laser-active supersonic gas flow therein. The coupling of microwaves to the flow is carried out with the aid of the LMP referred to in British Pat. No. 1,367,094 and serves to preionize an electrically excited gas-dynamic $CO_2$ laser with excitation in the supersonic flow region as a technically simpler and more economical alternative to the known preionization with the aid of an electron beam.

This known lateral coupling into the flow channel does, however, have a number of disadvantages. The microwave field strength is highest immediately adjacent to the "slow wave structure", i.e., at the edge of the channel, where the boundary layer is located, and decreases gradually towards the center of the channel. Consequently, the discharge develops preferentially in the boundary layer rather than in the flowing volume. In the boundary layer charged particles are rather lost by slow diffusion than carried away by the flow. Hence a layer of high electron density is established within the boundary layer which reflects part of the microwave energy and thus causes further decrease in the microwave field strength in the actual flow region. Although the ensuing field asymmetry in the channel can be eliminated by a similar configuration on the other side of the channel, a field strength minimum still remains at the center of the channel.

The object underlying the invention is to produce a microwave discharge in a supersonic flow such that the available microwave energy is deposited in the gas as completely as possible, and as uniformly as possible throughout the entire cross-section of the flow channel, in particular, in the central region of the gas flow.

This object is attained, in accordance with the invention, in a method of the kind described at the outset, by superposing the gas flow and the microwave field in the region in which expansion of the gas by means of a nozzle device causes the gas to be accelerated to supersonic speed, in that the direction of flow of the gas and the direction of propagation of the microwaves are made to be substantially the same, and in that the microwave field strength in the superposition region is chosen sufficiently high for a discharge to occur at the low pressure existing in that region.

The ionization, excitation and/or dissociation of the gas in the discharge region may serve to initiate plasma-chemical processes, with the simultaneously occurring gas-dynamic cooling of the working medium for "freezing" the chemical reaction being particularly advantageous, or to preionize a further non-selfsustained discharge for an electrically excited gas-dynamic laser. Furthermore, a self-sustained discharge can also be produced in this way in order to obtain a laser-active medium.

The occurrence of a marked expansion of the gas in the nozzle region, i.e., a large pressure drop, is advantageous because with the course of expansion a point is reached at which a discharge is initiated with substantially the same electrical field strength in this region. Since expansion of the gas proceeds from the nozzle throat in the direction of flow, the location of the discharge can be influenced by selection of the electrical field strength of the microwave field.

A further object of the invention is the provision of an apparatus for performing the method according to the invention.

This object is attained, in accordance with the invention, with an apparatus of the kind described at the outset, by disposing the flow channel, at least as far as beyond the supersonic nozzle, in a waveguide system, in which microwaves produced by a microwave generator connected to the waveguide system propagate substantially in the direction of the gas flow.

It is particularly advantageous if the walls of the waveguide system are identical to the walls of the flow channel. However, the walls of the flow channel may also be at least partially made of low-loss, dielectric material and disposed within the waveguide system. In this way, it is possible to provide the flow channel with a cross-section deviating from that of the waveguide, for example, to concentrate the flow channel in the central region of the waveguide where the electrical field strength is at a maximum and varies only slightly throughout the cross-section. In a rectangular waveguide, it is, for example, expedient to insert a dielectric plate at each of its narrow walls so that the cross-section of the flow channel is smaller than the cross-section of the waveguide.

In waveguides of arbitrary cross-section, a flow channel of rectangular cross-section delimited by dielectric walls may be disposed within the waveguide.

Depending on the purpose to be served, the waveguide itself may have various cross-sections, for example, it may be a circular waveguide, which is preferably of such dimensions as to allow only the propagation of the basic $TE_{11}$ mode.

The use of waveguides having a rectangular profile in the gas flow region is also advantageous, particularly if the broad wall of the rectangular waveguide is of such dimensions as to enable only the propagation of the basic $TE_{10}$ mode.

In a further preferred embodiment, the waveguide has an elliptical cross-section in the gas flow region or is in the form of a bulged out rectangular waveguide.

It is also favorable for a gas supply to be located in the plenum and for the waveguide to be terminated upstream of this gas supply by a low-loss dielectric pressure window.

In an apparatus of this kind comprising electrodes for producing an auxiliary discharge in the low pressure region, provision can be made for the waveguide to terminate upstream from the electrodes, and for the flow channel in the adjoining discharge area to consist of electrically insulating material, in which the electrodes are inserted.

In such an apparatus, the interior of the waveguide may be covered throughout the discharge area with low-loss, dielectric insulating material, in which the electrodes are so inserted as to be electrically insulated from the waveguide.

In a further preferred embodiment, provision is made for the the waveguide to terminate in the discharge area, while its broad walls are continued as a laterally open waveguide system, for the flow channel to be continued in electrically insulating material between these broad walls, and for the electrodes to be inserted in the narrow walls of this channel.

In a particularly advantageous embodiment of the invention, several waveguides, each surrounding its own flow channel, are arranged immediately adjacent to one another and merge in the low pressure region to form one common flow channel. The walls between two adjacent waveguides may be common to both waveguides. Each waveguide may be connected to its own microwave generator, but it is also advantageous to make provision for the microwaves to be fed from one waveguide into the neighboring one by a directional coupler arranged upstream from the gas supply to the waveguide. It is then sufficient to connect one waveguide to the microwave generator.

In such an embodiment, it is preferable that electrodes for producing a further discharge in the low pressure region be disposed in the common flow channel. The same applies to the provision of resonators in gas-dynamic laser systems. The invention also relates, in particular, to the design of the supersonic nozzle. In a circular waveguide, the nozzle for producing the supersonic flow may be a metallic component of the waveguide and likewise have a round cross-section. Upstream from the nozzle throat it is shaped such that the VSWR for microwaves is as low as possible, while the shape of the divergent part of the nozzle meets the requirements of gas dynamics, which are known per se.

Correspondingly, provision may be made in a rectangular waveguide for the nozzle for producing the supersonic flow to be a metallic component of the waveguide and to have a rectangular cross-section. In this case, too, the nozzle is shaped upstream of the nozzle throat such that the VSWR for microwaves is as low as possible, while the shape of the divergent part of the nozzle meets the gas-dynamic requirements known per se.

In a further embodiment of the invention, the nozzle consists of low-loss dielectric material and is shaped in accordance with the requirements of gas dynamics. BeO ceramic material, $Al_2O_3$ ceramic material, quartz or fused silica are particularly well suited materials therefor. The main advantage of such an embodiment consists in the substantial independence of the design criteria for the microwave propagation, on the one hand, and for the supersonic flow, on the other hand.

In addition, there is the advantageous possibility of constructing the nozzle in the form of a screen nozzle with several nozzle apertures.

The advantages gained by the subject of the application consist, in particular, in that a microwave discharge can be directly produced in a supersonic flow—with an inherently high mass flow—without the microwave radiation having to previously penetrate a boundary layer. In contrast to all known methods (including those where a subsonic flow is used), it is, therefore, possible, after slight transformation of the plasma impedance to the impedance of the waveguide system by a known impedance matching device (for example, E-H tuner or double screw tuner), to deposit the entirety of the available microwave energy in the gas or gas mixture.

Further advantages are apparent from the fact that the field distribution in the waveguide can be advantageously influenced by appropriate design of the waveguide. Accordingly, when the microwave discharge is used to preionize a non-selfsustained discharge, it is advantageous to select the dimensions of the waveguide such that only the propagation of the basic $TE_{10}$ mode is possible. The absence of components of the electric field strength at the narrow walls of the waveguide is characteristic thereof. Hence, in the boundary layer of the narrow wall of the flow channel there can be no plasma of high conductance, which could otherwise short the transversal main discharge. It is, furthermore, advantageous to create a field distribution which is as homogeneous as possible in the flow region by using a rectangular waveguide of bulged-out configuration or an elliptical waveguide and by provision of dielectric inserts to maintain the rectangular cross-section for the flow channel. Depending on the type of application, it may be advantageous to use either a metallic or a dielectric nozzle to produce the supersonic flow. With a metallic nozzle, the electric field strength is greatest in the nozzle throat area; at an appropriate pressure level the discharge will occur at this location. The VSWR depends on the geometry of the convergent part of the nozzle and on the mode used.

The use of a dielectric nozzle is uncritical as far as the VSWR is concerned. Depending on the composition of gas, field strength and pressure level, the discharge, in this case, only occurs downstream from the nozzle throat. It furthermore permits large area ratios to be realized, which is of decisive importance, particularly for the operation of a gas-dynamic CO laser. Moreover, it can be constructed as a screen nozzle with several apertures which is easy to manufacture. This is not possible with a metal nozzle as it would act as a reflecting short circuit for the guide wave.

Fused silica is a favorable material for the dielectric inserts and the nozzle, since it unites good mechanical and thermal properties and optical transparency (possibility of optical diagnostics) with a very small loss angle at microwave frequencies.

The following description of preferred embodiments of the invention serves, in conjunction with the drawings, the purpose of further explanation.

Figure 1:
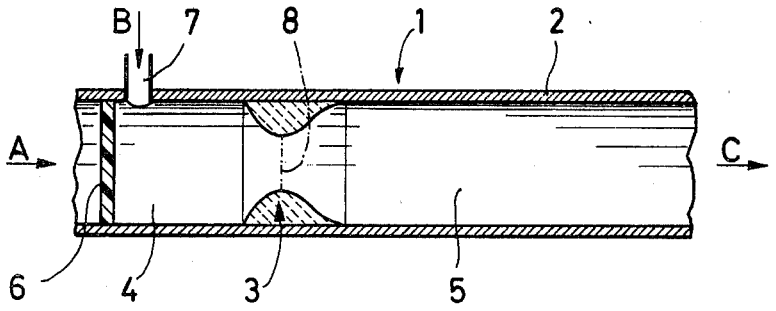
FIG. 1 is a longitudinal sectional view of a flow channel constructed as a waveguide for a supersonic gas flow which is to be ionized, excited and, if desired, dissociated.
Figure 2:
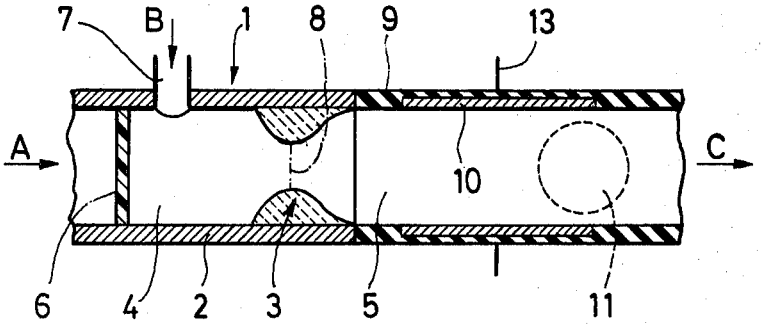
FIG. 2 is a view, similar to FIG. 1, of a modified embodiment.
Figure 2A:
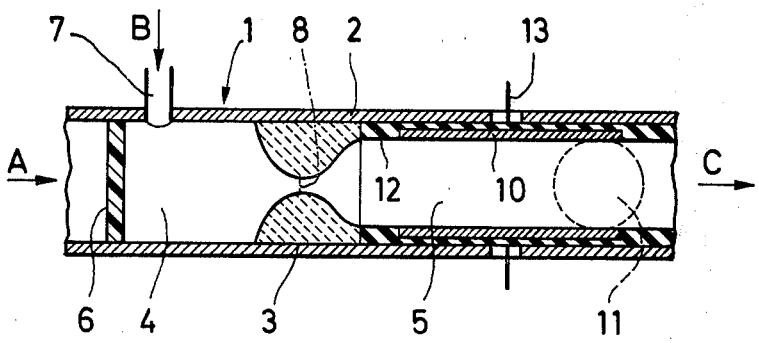

FIG. 2*a* is a view, similar to FIG. 1, of a further modified embodiment.

Figure 2B:
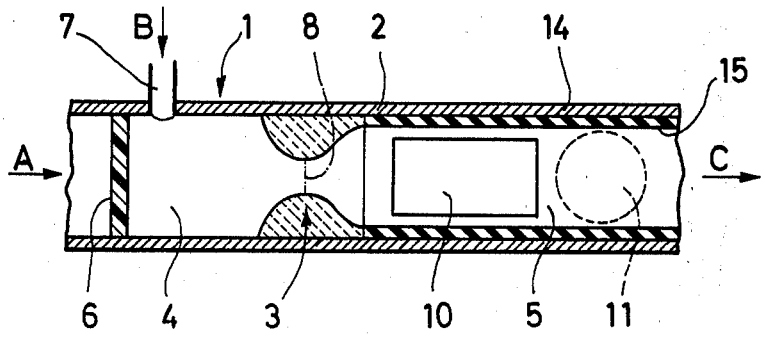

FIG. 2*b* is a view, similar to FIG. 1 of a further modified embodiment.

Figure 3:
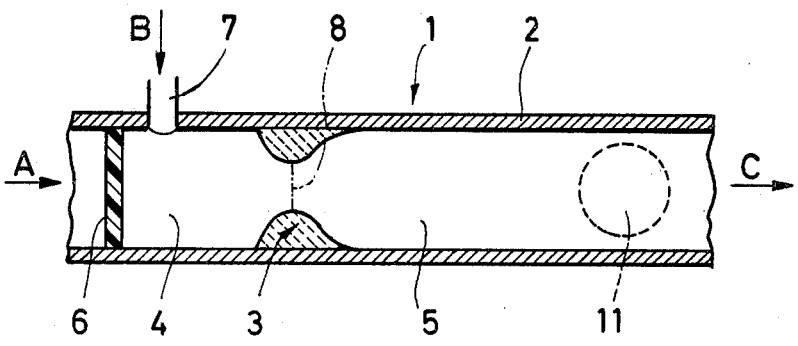

FIG. 3 is a view, similar to FIG. 1, of a further modified embodiment.

Figure 4:
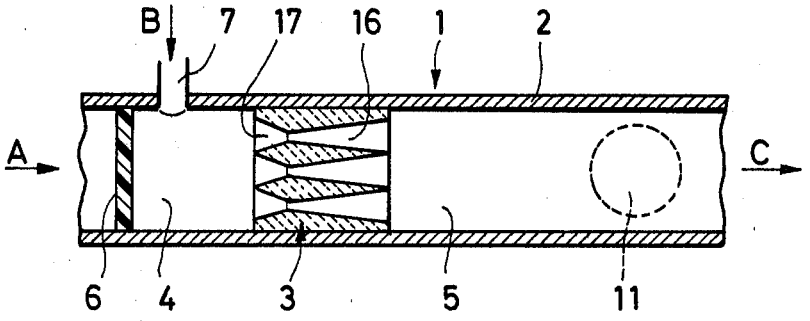

FIG. 4 is a view, similar to FIG. 1, of a further modified embodiment.

Figure 5:
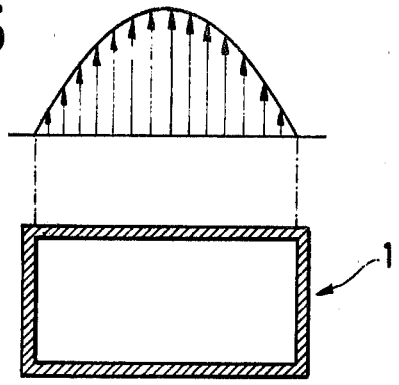

FIG. 5 is a cross-sectional view of a rectangular waveguide with associated distribution of the electric field in the $TE_{10}$ mode.

Figure 6:
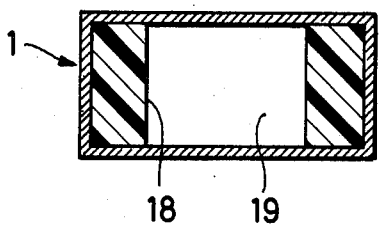

FIG. 6 is a cross-sectional view of a rectangular waveguide with dielectric portions inserted therein for delimitation of the flow cross-section.

Figure 7:
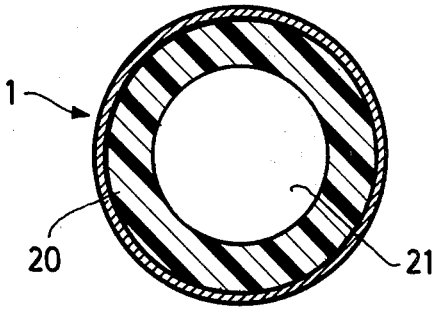

FIG. 7 is a view, similar to FIG. 6, of a waveguide with circular cross-section.

Figure 8:
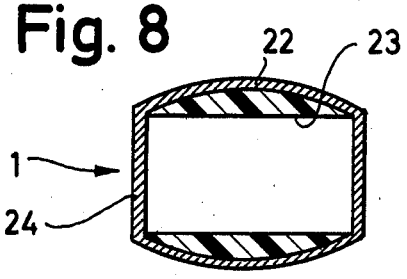

FIG. 8 is a view, similar to FIG. 6, of a waveguide whose broad walls are of bulged-out configuration.

Figure 9:
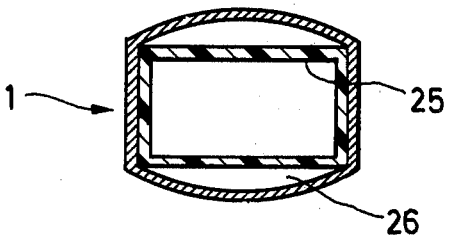

FIG. 9 is a view, similar to FIG. 6, of a waveguide with bulged-out walls and a rectangular flow channel made of loss-free material inserted therein.

Figure 10:
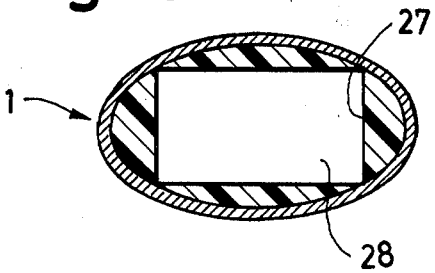

FIG. 10 is a view, similar to FIG. 6, of a waveguide with an elliptical cross-section and rectangular flow channel delimitation.

Figure 11:
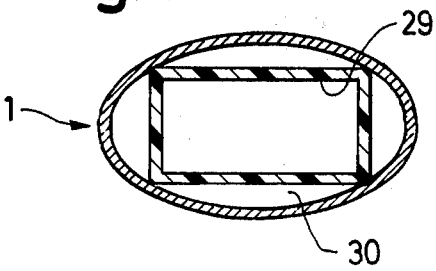

FIG. 11 is a view, similar to FIG. 6, of a waveguide of elliptical cross-section with a flow channel of rectangular cross-section made of loss-free material inserted therein.

Figure 12:
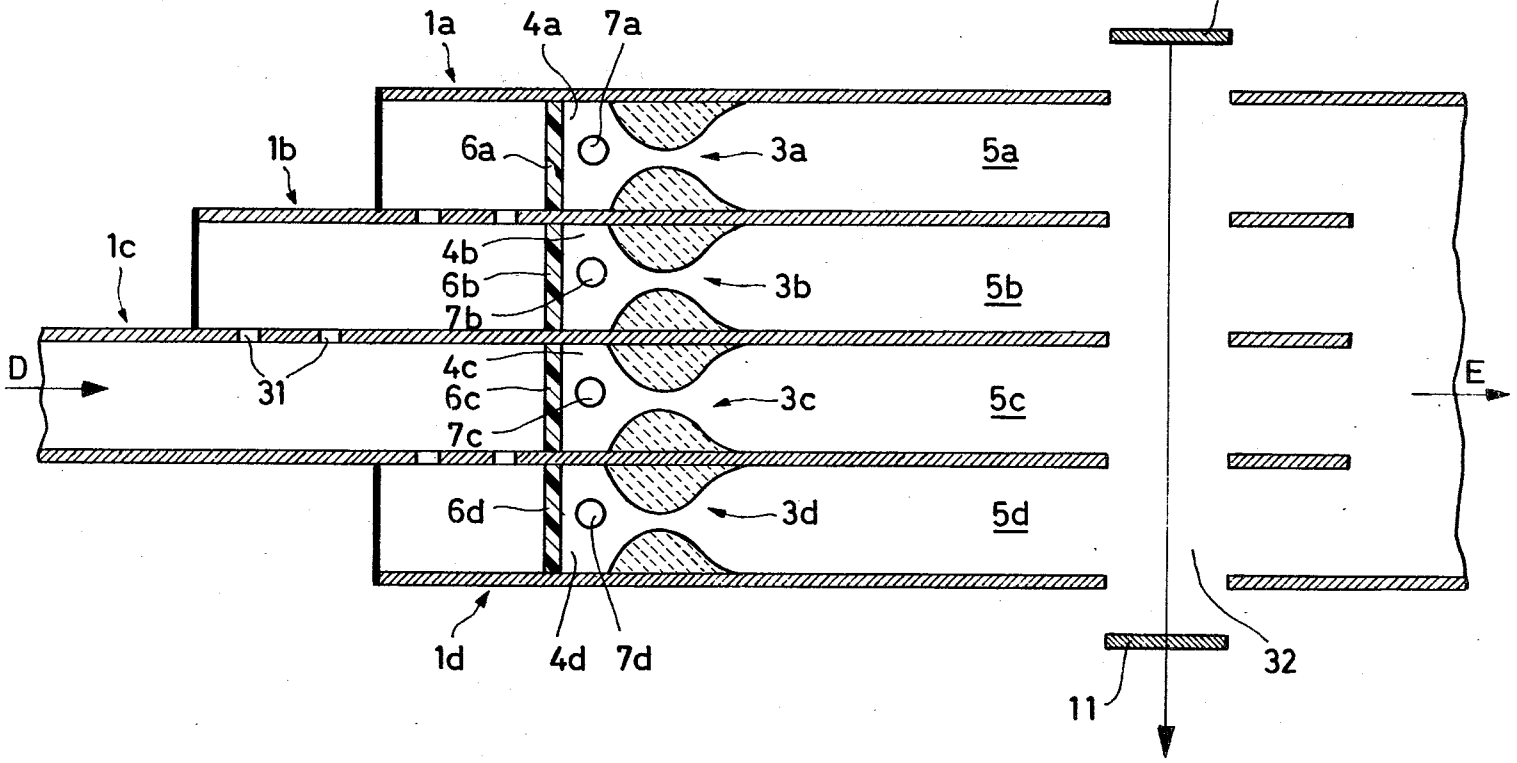

FIG. 12 is a longitudinal sectional view of a unit with several waveguides arranged adjacent one another.

FIG. 1 illustrates part of a waveguide 1 with metallic walls 2, comprising on its left side a microwave generator known per se, for example, a magnetron or a clystron, which is not illustrated in the drawings. Inside the waveguide there is a nozzle shaped construction, which shall be referred to in the following as supersonic nozzle 3. In the embodiment shown, the latter consists of a low-loss, dielectric material, for example, quartz or fused silica, or a BeO ceramic material or $Al_2O_3$ ceramic material.

The supersonic nozzle 3 divides the interior of the waveguide 1 into two regions, namely a plenum 4, and a low pressure region 5 located downstream. The plenum 4 is delimited on the side opposite the supersonic nozzle 3 by a pressure window 6 which seals the waveguide 1 off from the microwave generator in a gas tight manner. This pressure window 6 consists of a low-loss, dielectric material. The plenum 4 is connected via a supply line 7 to a gas supply which is not illustrated in the drawings.

In operation, the microwave radiation propagates within the waveguide in the direction of the arrow A, with the propagation hardly being influenced by the pressure window 6 and the supersonic nozzle 3, which both consist of a low-loss, dielectric material. The gas to be excited is introduced in the direction of the arrow B through the supply line 7 into the plenum 4 and then flows through the supersonic nozzle 3. After passing the narrowest point 8, it undergoes an expansion and the simultaneous acceleration to supersonic speed. The supersonic nozzle 3 is optimally shaped in relation to the dynamics of the flowing expanding gas. In this instance, such optimal shaping, which is known per se, can be readily realized, since the supersonic nozzle being made of dielectric material, does not hinder the propagation of the microwaves, and there is, consequently, a substantially distortionless microwave field in the region upstream of the nozzle, in the region of the nozzle itself, and in the region downstream of the nozzle.

Since there is a large pressure loss in the gas after passing the narrowest point 8 of the nozzle 3, the breakdown field strength is substantially lower, and a discharge therefore occurs on account of the given electric field strength of the microwave field in the nozzle region adjacent to the narrowest point 8, provided the electric field strength is chosen high enough. The gas excited by this discharge then flows in the direction of the arrow C through the low pressure region where the microwave excited gas is suitably used.

In the embodiment shown in FIG. 1, the flow channel is formed in both the plenum and the low pressure region by the metal walls of the waveguide. The main difference between the embodiment of FIG. 1 and that of FIG. 2, where corresponding parts are designated with the same reference numerals as in the embodiment of FIG. 1, consists in that the waveguide 1 terminates at the end of the supersonic nozzle 3, and the flow channel in the low pressure region 5 is formed by walls 9 which are made of electrically insulating material and are mounted flush with the metal walls of the waveguide 1. Embedded in two opposite walls 9 of the embodiment shown in FIG. 2 are electrodes 10 between which an additionally superposed non-selfsustained or selfsustained discharge in the gas flowing between the electrode plates can be produced by application of a voltage. The two electrodes 10 are insulated from each other by using electrically insulating wall material.

The system shown in FIG. 2 is particularly well suited for the production of an active laser medium. On leaving the gas discharge, the excited gas flows between the electrode plates through a resonator delimited by two resonator mirrors 11. One resonator mirror 11 is indicated in dashed lines in FIG. 2. The optical axis of the resonator extends perpendicular to the flow direction and parallel to the electrodes 10. The microwave discharge occurring between the point 8 with the narrowest cross-section and the end of the waveguide 1 serves to preionize the non-selfsustained transverse discharge between the electrodes 10.

FIG. 2*a* shows a further embodiment wherein, as in the embodiment shown in FIG. 1, the metal walls 2 of the waveguide 1 surround the flow channel throughout its entire length, i.e., also in the low pressure region 5. In this region, however, the waveguide 1 is covered throughout its interior with a dielectric low-loss insulating material 12 disposed substantially flush with the divergent contour of the supersonic nozzle 3. Electrodes 10 are embedded in this insulating material 12 so as to be electrically insulated from the metallic walls 2 of the waveguide 1. The connectors 13 of the electrodes 10 extend in an insulated manner through the metallic walls 2 of the waveguide 1. In such a system, the purpose of the microwave discharge is primarily that of stabilizing a superimposed dc-discharge between the electrodes 10.

The system shown in FIG. 2*b* is also suited to this purpose. In contrast to the system shown in FIG. 2*a*, only the narrow walls of the waveguide 1 terminate at the end of the supersonic nozzle 3, while the broad walls 14 are continued as a strip guide. In the low pressure region 5, the flow channel is surrounded by dielectric walls 15 which are mounted flush with the divergent contour of the supersonic nozzle 3. Electrodes 10 are embedded upstream of the resonator mirrors 11 in the narrow walls of the dielectric flow channel.

FIG. 3 illustrates an embodiment corresponding substantially to that of FIG. 1, but wherein the waveguide 1 is of rectangular cross-section and the supersonic nozzle 3 is in the form of a slit nozzle. Mirrors 11 are located in the low pressure region 5 to form a resonator for the excited laser gas. In this embodiment, the excitation does not occur with the aid of a discharge produced between electrodes in the low pressure region, but exclusively by the discharge produced by the microwave field in the region of the pressure drop. A functioning laser was obtained using such a simple system, with the following data: An available cw-microwave power of $P_{in}=5$ kW and a mass flow of $m=40$ g/sec in a gas mixture consisting of 5% CO in 95% He resulted in a laser power of 165 W with a wavelength of approximately 5 $\mu$m.

In substantially the same construction, shown in FIG. 4, the supersonic nozzle 3 is in the form of a screen nozzle, i.e., it has several nozzle apertures 16 arranged adjacent one another, all of which widen from a nozzle throat 17 in the direction of the low pressure region 5. The advantage of such nozzles consists in the shorter total length, the less critical manufacturing tolerances and the greater constancy of their dimensions during operation. This is particularly applicable if the ratio of the final cross-section of the nozzle to the cross-section of the nozzle throat is large. Nozzles of such a design must consist of an electrically insulating material as they would otherwise short the opposite walls of the waveguide 1.

In principle, the cross-sectional shape of the waveguide can be made to conform with the requirements. In the embodiments shown, there is depicted in FIG. 1 a waveguide of circular cross-section, and in FIGS. 2 to 4 a waveguide of rectangular cross-section. In principle, the different variants illustrated in FIGS. 1 to 4 can be realized in waveguides of different cross-section.

In FIG. 5, the sinusoidal distribution of the electric field strength of the $TE_{10}$ mode, which is known per se, is illustrated above the rectangular cross-section of a waveguide 1. This field distribution is particularly favorable for the preionization of a non-selfsustained discharge existing in an adjoining channel between electrodes inserted in the broad walls. As a result of the low microwave field in the proximity of the narrow walls of the waveguide, it is not—as in other methods—primarily in the boundary layer that electrons which do not contribute to ionization in the flow region are produced, but substantially in the central region.

If, however, the microwave discharge is used as a selfsustained discharge for the direct production of a laser medium (embodiment shown in FIG. 3), the said effect is rather unfavorable, since a lot of non-ionized cold gas flows down the narrow walls of the channel. This is prevented in the example shown in FIG. 6 by inserting at the narrow walls dielectric plates 18 whose dimensions are of such thickness as to allow the remaining flow channel cross-section 19 to concentrate the gas in the region of high and not greatly varying field strength. Basically, the insertion of the dielectric plates 18 does not cause a disturbance in the field strength distribution.

Similar measures may be taken in a waveguide of circular cross-section, as illustrated, for example, in FIG. 1. In FIG. 7, such a circular waveguide 1 is shown in cross-section, and is covered on the inside with a concentrically extending dielectric layer 20. This layer concentrates the gas flow on a reduced cross-section 21 in the proximity of the longitudinal axis of the waveguide.

The field strength distribution should, of course, be kept constant substantially throughout the entire cross-section of the flow channel. In order to attain this, the field strength distribution, which is sinusoidal in a normal rectangular waveguide (FIG. 5), can be smoothed out by alteration of the cross-sectional shape. In the example shown in FIG. 8, the broad walls 22 of the rectangular waveguide 1 are curved in an outward direction. Within the waveguide, adjacent the broad walls 22, are dielectric inserts 23 which, together with the narrow walls 24 of the waveguide, form a flow channel of rectangular cross-section. FIG. 9 illustrates a similar configuration of the waveguide 1. In the interior of this waveguide there is a completely sealed off flow channel 25 made of dielectric material and of rectangular cross-section. The cavities 26 between the flow channel 25 and the bulged-out walls of the waveguide 1 are filled with a dielectric medium, for example, with an inert gas at higher pressure level which prevents a breakdown at this point.

Waveguides 1 of elliptical cross-section are shown in FIGS. 10 and 11. Dielectric inserts 27 are used in the example given in FIG. 10 to form a flow channel 28 of rectangular cross-section. Similar to the example shown in FIG. 9, in that of FIG. 11, a flow channel 29 consisting of dielectric walls closed on all sides is inserted in the waveguide. Here, too, the spaces 30 between the wall of the waveguide and the wall of the flow channel are filled with a dielectric medium, for example, an inert gas at higher pressure level.

A modified embodiment of a system for the excitation of gas by means of a microwave field is illustrated in FIG. 12. This system includes a plurality of waveguides 1*a*, 1*b*, 1*c* and 1*d*, whose broad walls are arranged immediately adjacent to one another. Each dividing wall between adjacent waveguides is of integral construction. In each waveguide there is—exactly as in the above-described embodiments—a supersonic nozzle 3*a*, 3*b*, 3*c* and 3*d*, which divides the interior of the waveguide into a plenum 4*a*, 4*b*, 4*c* and 4*d* and a low pressure region 5*a*, 5*b*, 5*c* and 5*d*. The plenums are sealed off in a gas tight manner by pressure windows 6*a*, 6*b*, 6*c* and 6*d*. The gas is introduced into the plenums through the gas inlets 7*a*, 7*b*, 7*c* and 7*d*.

In the embodiment shown, only the waveguide 1*c* is connected, in a manner not illustrated in the drawing, to a microwave generator which supplies microwave radiation propagating in the direction of the arrow D. The adjacent waveguides 1*b* and 1*d* obtain their microwave power from the waveguide 1*c*. To this end, they are connected like directional couplers to the waveguide 1*c*, i.e., via two spaced openings 31. The waveguide 1*a* is coupled to the waveguide 1*b* by such a directional coupler. In this way, the microwave power delivered by the generator is distributed over the individual adjacent waveguides. In each waveguide, a discharge is produced by the microwave field in the supersonic gas flow. The excited gas finally exits from the individual waveguides into a common low pressure region 32 forming a laser cavity with its axis aligned transversely to the direction of flow. This laser resonator is delimited by mirrors 11. The gas is then conveyed further in the direction of the arrow E to a pump means.

In this system, a substantially uniform excitation of the gas flow throughout the entire cross-section of the laser resonator is attained; if broad rectangular waveguides are used, a large cross-sectional area of a uniformly highly excited laser gas can be produced.

In the last above-described system, the excitation procedure takes place in substantially the same way as in the above-described systems, where only one waveguide is provided. It is, of course, possible to provide each of the adjacent waveguides with its own microwave generator.

In all cases, complete deposition of the microwave power in the gas flow is possible with the system according to the invention, preferably in the central region of the flow channel, i.e, in contrast to all other known apparatuses, not in the undesired edge region. As indicated repeatedly, the ionization, excitation and/or dissociation of the gas obtained with the microwave discharge may serve both to initiate plasma-chemical processes and to preionize a non-selfsustained discharge or to maintain a selfsustained discharge. Naturally, the fields of application are not limited to plasma-chemical processes and the excitation of gas-dynamic lasers.

It is, of course, understood that although the supersonic nozzles 3 of the embodiments described consist exclusively of low-loss, dielectric material, it is, in principle, also possible to construct these nozzles as a metallic component of the waveguide. The use of low-loss, dielectric material is advantageous insofar as the nozzle hardly impairs the microwave radiation at all, and the shape of the nozzle can, therefore, be made to conform precisely with the requirements of gas dynamics. If, on the other hand, metallic nozzles are used, the microwave field is distorted. In this instance, it is advantageous to construct the nozzle in the region upstream of the narrowest point in a manner known per se such that the influence on the microwave field is as slight as possible, i.e., that as little microwave reflection as possible occurs, while the shape downwstream of the narrowest point is made to meet the requirements of gas dynamics.

What is claimed is:

1. Apparatus for producing a discharge in a supersonic gas flow comprising:

(a) a waveguide;

(b) a channel for gas flow formed within said waveguide;

(c) means for causing gas flow through the channel;

(d) a microwave generator connected to said waveguide for propagating microwaves substantially in the direction of gas flow;

(e) a supersonic nozzle in the channel for expansion and simultaneous acceleration of the gas to supersonic speed, said nozzle dividing the channel into an upstream plenum and a downstream low pressure region;

(f) said nozzle comprising a low-loss dielectric material; and (g) dielectric material placed adjacent the interior wall of said waveguide to concentrate gas flow in the region of high field strength.

2. Apparatus as defined in claim 1 wherein said waveguide has a rectangular cross-section and said dielectric material comprises a dielectric plate disposed adjacent each narrow wall of said waveguide so that the cross-section of said gas flow channel is smaller than the cross-section of said waveguide.

3. Apparatus as defined in claim 1 wherein said waveguide has a circular cross-section and said dielectric material comprises an annular dielectric element disposed adjacent the interior wall of said waveguide.

4. Apparatus as defined in claim 1 wherein electrodes are embedded in said dielectric material.

5. Apparatus as defined in claim 1, wherein a plurality of waveguides (1*a*, 1*b*, 1*c*, 1*d*), each surrounding its own flow channel, are disposed immediately adjacent to one another and merge into one common flow channel (32) in the low pressure region.

6. Apparatus as defined in claim 5, characterized in that the walls between each two adjacent waveguides (1*a*, 1*b*, 1*c*, 1*d*) are common to both waveguides.

7. Apparatus as defined in claim 5, characterized in that the microwave is fed from one waveguide (1*c*; 1*b*) into the adjacent waveguide (1*b*, 1*d*; 1*a*) by a directional coupler disposed upstream from the gas supply (7*a*, 7*b*, 7*c*, 7*d*) to the waveguide.

* * * * *